US005605134A

United States Patent [19]

Martin

[11] Patent Number: 5,605,134

[45] Date of Patent: Feb. 25, 1997

[54] HIGH PRESSURE ELECTRONIC COMMON RAIL FUEL INJECTOR AND METHOD OF CONTROLLING A FUEL INJECTION EVENT

[76] Inventor: Tiby M. Martin, 3836 Holly La., Waterloo, Iowa 50702

[21] Appl. No.: 421,616

[22] Filed: Apr. 13, 1995

[51] Int. Cl.[6] ..... F02M 41/00

[52] U.S. Cl. ..... 123/467; 123/498

[58] Field of Search ..... 123/458, 446, 123/496, 467, 498

[56] References Cited

U.S. PATENT DOCUMENTS

| | | | |
|---|---|---|---|
| 3,331,327 | 7/1967 | Roosa . | |
| 3,604,402 | 9/1971 | Hatz . | |
| 3,971,259 | 7/1976 | Schottler . | |
| 4,392,466 | 7/1983 | Moybray et al. . | |
| 4,509,691 | 4/1985 | Skinner . | |
| 4,527,737 | 7/1985 | Deckard . | |
| 4,550,875 | 11/1985 | Teerman et al. . | |
| 4,603,671 | 8/1986 | Yoshinaga et al. . | |
| 4,640,252 | 2/1987 | Nakamura | 123/467 |
| 4,673,337 | 6/1987 | Miller . | |
| 4,732,129 | 3/1988 | Takigawa | 123/498 |
| 4,782,807 | 11/1988 | Takahashi | 123/498 |
| 4,784,101 | 11/1988 | Iwanaga | 123/467 |
| 5,035,221 | 6/1991 | Martin . | |
| 5,057,734 | 10/1991 | Tsuzuki | 123/498 |
| 5,156,132 | 10/1992 | Iwanaga | 123/467 |
| 5,237,968 | 8/1993 | Miller | 123/498 |

FOREIGN PATENT DOCUMENTS

| | | | |
|---|---|---|---|
| 2221309 | 12/1973 | Germany . | |
| 62-660A | 1/1987 | Japan . | |
| 65-85265A | 4/1988 | Japan . | |
| 0147143 | 6/1989 | Japan | 123/498 |
| 5044590 | 2/1993 | Japan | 123/498 |
| 6147052 | 5/1994 | Japan | 123/498 |
| 65846 | 1/1950 | Netherlands . | |
| 2118624 | 3/1963 | United Kingdom . | |

OTHER PUBLICATIONS

SAE Technical Paper Series 880421, "EMI–Series–Electromagnetic Fuel Injection Pumps" by Michael M. Schechter and Aladar O. Simko (1988).

SAE Technical Paper Series 881098, "EEC IV Full Authority Diesel Fuel Injection Control" by William Weseloh (1986).

SAE Technical Paper Series 850453, "An Electronic Fuel Injection System for Diesel Engines" by P. E. Glikin (1985).

SAE Technical Paper Series 840273, "Direct Digital Control of Electronic Unit Injectors" by N. John Beck, et al. (1984).

SAE Technical Paper Series 810258, "Electronic Fuel Injection Equipment for Controlled Combustion in Diesel Engines" by R. K. Cross, et al. (1981).

*Primary Examiner*—Carl S. Miller

*Attorney, Agent, or Firm*—Woodard, Emhardt, Naughton Moriarty & McNett

[57] ABSTRACT

A fuel injector which, under the control of the engine ECM, may control the shape of the fuel injection event profile. Such control is achieved by varying the magnitude of a control current applied to the injector. The control current in turn varies the bias force applied to a needle valve in the injector nozzle, thereby changing the shape of the injection event profile in proportion to the amount of control current applied. In a preferred embodiment, control of the bias force is achieved by placing a piezoelectric actuator between the needle valve and a bias spring. The length of the piezoelectric actuator changes in proportion to the amount of control current applied thereto, thereby changing the bias force applied to the needle valve. The profile is preferably altered in relation to engine speed.

24 Claims, 16 Drawing Sheets

---- ADJUSTMENT POSSIBILITIES

HIGH PRESSURE ELECTRONIC COMMON RAIL FUEL INJECTOR AND METHOD OF CONTROLLING A FUEL INJECTION EVENT

TECHNICAL FIELD OF THE INVENTION

This invention is related to a high-pressure, common rail, fuel injector for injecting metered amounts of highly pressurized fuel into the cylinder of a diesel engine.

BACKGROUND OF THE INVENTION

Conventional fuel injection systems employ a "jerk" type fuel system for pressurizing and injecting fuel into the cylinder of a diesel engine. A pumping element is actuated by an engine-driven cam to pressurize fuel to a sufficiently high pressure to unseat a pressure-actuated injection valve in the fuel injection nozzle. In one form of such a fuel system having an electromagnetic unit injector, the plunger is actuated by an engine driven cam to pressurize the fuel inside the bushing chamber when a solenoid is energized and the solenoid valve is closed. The metering and timing is achieved by a signal from an electronic control module (ECM) having a controlled beginning and a controlled pulse. In another form of such a fuel system, the fuel is pressurized by an electronic or mechanical pumping assembly into a common rail and distributed to electromagnetic nozzles, which inject pressurized fuel into the engine cylinders. Both the electronic pump and the electromagnetic nozzles are controlled by the ECM signal.

One problem with using a common rail results from the high pressures experienced in diesel engines, which are in the neighborhood of up to a maximum of 30,000 psi. Another problem in conventional fuel injection systems is achieving a controlled duration and cut-off of the fuel injection pressure. Standard fuel injection systems commonly have an injection pressure versus time curve (the fuel injection event profile) in which the pressure increases to a maximum and then decreases, following a somewhat skewed, triangularly-shaped curve. Such a pressure versus time relationship initially delivers a relatively poor, atomized fuel penetration into the engine cylinder because of the low injection pressure. When the pressure curve reaches a certain level, the pressure provides good atomization and good penetration. As the pressure is reduced from its peak pressure, the decreasing pressure again provides poor atomization and penetration, and the engine discharges high emissions of particulates and smoke.

One of the objects of fuel injection designers is to reduce unburned fuel by providing a pressure versus time curve having a square configuration, with an initially high pressure increase to an optimum pressure, providing good atomization, and a final sharp drop to reduce the duration of poor atomization and poor penetration.

Additionally, the optimum delivery of fuel to an engine cylinder (i.e. the profile of the injection curve) is dependent upon engine speed. Consequently, an injection pressure vs. time curve which is ideal at a first engine speed will be less than ideal at a second engine speed. Consequently, prior art fuel injectors have been designed to have a pressure vs. time curve which provides acceptable (but not optimum) performance at all engine speeds. There is therefore a need for a fuel injector which is capable of "rate shaping", i.e. changing the shape of its injection profile with changing engine speed. Such rate shaping allows for reduced emission of particulates and hydrocarbons and also reduced fuel consumption.

The present invention is therefore directed toward providing a high pressure electronically controlled common rail fuel injector which allows for rate shaping of the injection curve under the control of the engine ECM.

SUMMARY OF THE INVENTION

The present invention relates to a fuel injector which, under the control of the engine ECM, may control the shape of the fuel injection event profile. Such control is achieved by varying the magnitude of a control current applied to the injector. The control current in turn varies the bias force applied to a needle valve in the injector nozzle, thereby changing the shape of the injection event profile in proportion to the amount of control current applied. In a preferred embodiment, control of the bias force is achieved by placing a piezoelectric actuator between the needle valve and a bias spring. The length of the piezoelectric actuator changes in proportion to the amount of control current applied thereto, thereby changing the bias force applied to the needle valve. The profile is preferably altered in relation to engine speed.

In one form of the invention a high pressure electronic common rail fuel injector is disclosed, comprising an injector body having a fuel inlet therein; a first fuel chamber formed within the injector body and in fluid communication with the fuel inlet; a second fuel chamber formed within the injector body; a nozzle coupled to the injector body; a first fuel passage fluidly coupling the second fuel chamber to the nozzle; a shuttle valve seat formed in the injector body between the first and second fuel chambers; a shuttle valve slidingly disposed within the injector body; and a piezoelectric shuttle valve actuator coupled to the shuttle valve, wherein activation of the piezoelectric shuttle valve actuator operates to unseat the shuttle valve from the shuttle valve seat, thereby allowing fuel flow between the first and second fuel chambers, and deactivation of the piezoelectric shuttle valve actuator operates to seat the shuttle valve on the shuttle valve seat, thereby preventing fuel flow between the first and second fuel chambers.

In another form of the invention a fuel injector, comprising an injector body having a fuel inlet therein; a nozzle coupled to the injector body; a first fuel passage fluidly coupling the fuel inlet and the nozzle; a needle valve seat formed in a distal end of the nozzle;a needle valve slidingly disposed within the nozzle; and a controllable biasing member coupled to the needle valve and operative to apply a variable biasing force to the needle valve in a direction tending to seat the needle valve against the needle valve seat; wherein the variable biasing force is varied by varying an amount of current applied to the controllable biasing member.

In another form of the invention a method of controlling a fuel injection event in an engine is disclosed, comprising the steps of: (a) supplying pressurized fuel to a fuel injector, the fuel injector comprising an injector body having a fuel inlet therein; a nozzle coupled to the injector body; a first fuel passage fluidly coupling the fuel inlet and the nozzle; a needle valve seat formed in a distal end of the nozzle; a needle valve slidingly disposed within the nozzle; and a controllable biasing member coupled to the needle valve and operative to apply a variable biasing force to the needle valve in a direction tending to seat the needle valve against the needle valve seat; wherein the variable biasing force is varied by varying an amount of current applied to the controllable biasing member; (b) sensing an engine speed of the engine; (c) determining an optimum profile of the fuel injection event based upon the engine speed; and (d) varying the amount of current applied to the controllable biasing member during the fuel injection event in order to produce the optimum profile.

In another form of the invention a method of controlling a fuel injection event in an engine is disclosed, comprising the steps of: (a) supplying pressurized fuel to a fuel injector, the fuel injector comprising an injector body having a fuel inlet therein; a nozzle coupled to the injector body; a first fuel passage fluidly coupling the fuel inlet and the nozzle; a needle valve seat formed in a distal end of the nozzle; a needle valve slidingly disposed within the nozzle; and a controllable biasing member coupled to the needle valve and operative to apply a variable biasing force to the needle valve in a direction tending to seat the needle valve against the needle valve seat; wherein the variable biasing force is varied by varying an amount of current applied to the controllable biasing member; (b) determining an optimum profile of the fuel injection event; and (c) varying the amount of current applied to the controllable biasing member during the fuel injection event in order to produce the optimum profile.

DETAILED DESCRIPTION OF THE PREFERRED EMBODIMENTS

Figure 1:
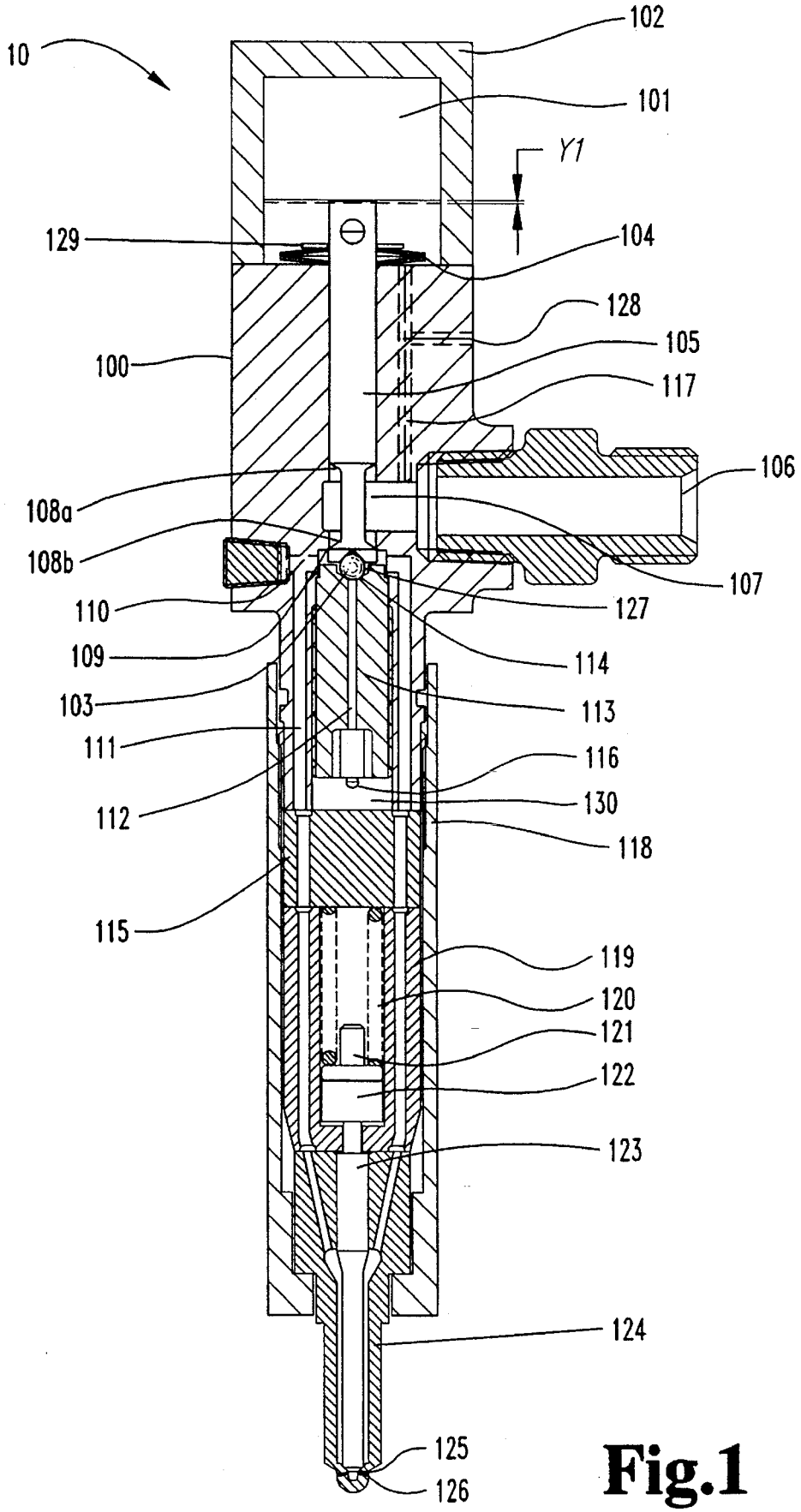
FIG. 1 is a cross sectional view of a first embodiment fuel injector of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a high pressure electronic common rail fuel injector of the present invention, indicated generally at 10. The injector 10 comprises an injector body 100 having a nozzle retainer 118 mounted to a distal end thereof. A fuel inlet fitting 106 is threadingly engaged to the injector body 100 in order to receive fuel from a common rail fuel injection system (not shown.). Fuel passes through the fuel inlet 106 into an equalized pressure chamber 107 formed within the injector body 100. A shuttle valve 105 is slidably retained within the injector body 100 and passes through the equalized pressure chamber 107. The proximal end of the shuttle valve 105 is coupled to a piezoelectric actuator 101. The piezoelectric actuator 101 exhibits the property that when a current is applied thereto, it changes its dimension in the longitudinal direction. Application of varying amounts of current thereto will produce varying amounts of longitudinal expansion. The piezoelectric actuator 101 is contained within a cover 102 which is sealingly engaged to the injector body 100. A suitable piezoelectric actuator 101 is of PZT type, manufactured by Morgan Matroc, Inc. of Beford, Ohio.

The shuttle valve 105 contains an annular recess in the area where it passes through the equalized pressure chamber 107. The upper portion of this annular recess creates a shoulder 108A, while the lower portion of this annular recess creates the shoulder 108B. It will be appreciated by those skilled in the art that fuel entering the equalized pressure chamber 107 will create a balanced upward and downward axial force on the shuttle valve 105 by means of the interaction between the pressurized fuel and the shoulders 108A and 108B. Therefore, the pressure in the incoming fuel does not create any net upward or downward force on the shuttle valve 105. A retaining surface 129 is coupled to the shuttle valve 105 in the area between the piezoelectric actuator 101 and the top of the actuator body 100. A biasing spring 104 is coupled between the retaining surface 129 and the upper surface of the injector body 100, thereby producing an upward bias force on the shuttle valve 105. The upward bias force produced by the spring 104 acts to retain the shuttle valve 105 engaged with its valve seat 109, thereby preventing any fuel flow from the equalized pressure chamber 107 to the fuel passage 110.

Figure 2:
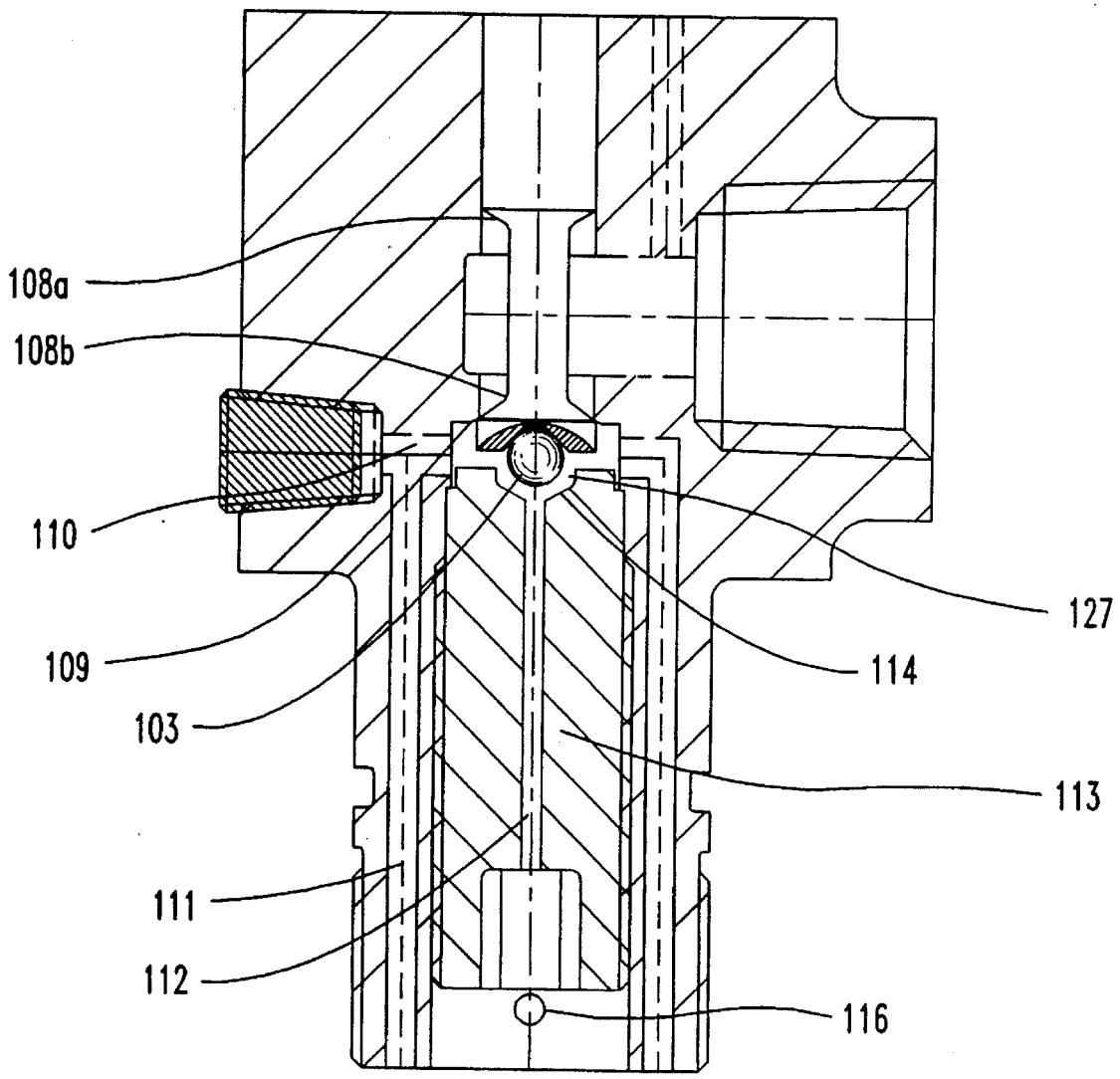
FIGS. 2–5 are partial cross sectional views of the first embodiment fuel injector of FIG. 1.

As can be seen in greater detail in the enlargement of FIG. 2, a check ball 103 resides within a fuel chamber 127 formed by a frustoconical recess in the bottom of the shuttle valve 105 and a hemispherical recess 114 formed in a check ball spacer member 113. The hemispherical recess 114 forms a seat for the check ball 103. A passageway 112 through the spacer 113 couples the fuel chamber 127 to a pressure chamber 130 below the spacer 113. A small side hole 116 is formed in the pressure chamber 130 in order to slowly relieve pressure within this chamber. The side hole 116 communicates with the passages 117 and 128, which are coupled to a return line to the fuel tank (not shown).

The frustoconical recess formed in the bottom of shuttle valve 105 ensures that a greater surface area on the bottom half of the check ball 103 is exposed to the pressurized fuel in the fuel chamber 127 than is the exposed surface area on the top half of check ball 103. This has the effect of producing a net upward force on the check ball 103.

When the shuttle valve 105 is unseated from its valve seat 109, fuel flows from the equalized pressure chamber 107 to the inlet 110 and the passage 111 to the nozzle 124 at the distal end of the injector 10. An identical path to the nozzle 124 is formed on the opposite side of the injector 10. These complimentary fuel passages must pass through a spacer 115 and a spring cage 119 prior to reaching the nozzle 124.

A bias spring 120 is held within a cylindrical hollow bore in the spring cage 119 and is compressed between the bottom of the spacer 115 and the top of a spring seat 121. A second piezoelectric actuator 122 is coupled between the bottom of the spring seat 121 and the top of a needle vane 123 which is slidingly engaged by a passage through the injector nozzle 124. The distal end of the needle valve 123 mates with a valve seat 125 formed by the nozzle 124. Mating and unmating of the needle valve 123 with the valve seat 125 controls flow of fuel from the passage 111 through the spray holes 126. The injector 110 is mounted in an engine (not shown) such that fuel exiting the spray holes 126 is applied to the engine cylinders.

As discussed hereinabove, when the piezoelectric shuttle valve actuator 101 is not activated (i.e. no current is applied thereto), the bias spring 104 acts upon the retaining ring 129 to bias the shuttle valve 105 in an upward direction, thereby seating the shuttle valve 105 against its valve seat 109. This action prevents fuel from flowing between the equalized pressure chamber 107 and the fuel chamber 127. In this configuration, the injector 10 is turned off, and no fuel flows from the spray holes 126. This configuration is illustrated in magnified detail in FIG. 2.

Figure 3:
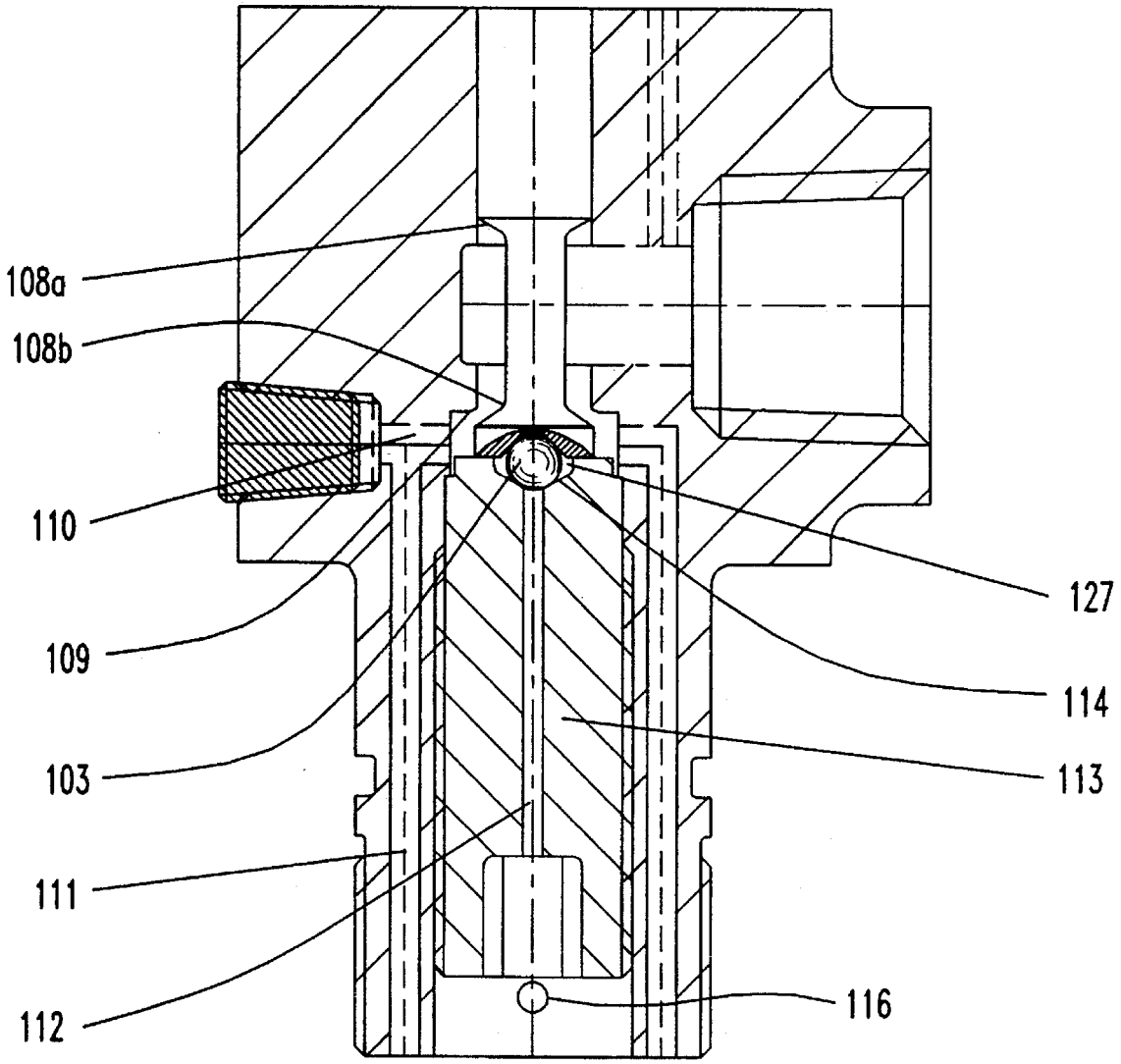

However, when a current is applied to the piezoelectric shuttle valve actuator 101, it increases its longitudinal dimension by the amount indicated as Y1 in FIG. 1. As shown in the magnified view of FIG. 3, movement of the shuttle valve 105 by the amount Y1 is adequate to unseat the shuttle valve 105 from its valve seat 109, thereby allowing fuel flow between the equalized pressure chamber 107 and the fuel chamber 127. Also, movement of the shuttle valve 105 in a downward direction operates to press the check ball 103 against the check ball valve seat 104, thereby preventing fuel flow through the passage 112 and into the pressure chamber 130. In this position, fuel flows from the fuel inlet 106, through the twin fuel passages 110/111 and to the hollow cavity surrounding the needle valve 123 in the nozzle 124. When the upward force created by the high pressure fuel acting on the needle valve 123 exceeds the spring pretension on the spring 120, the needle valve 123 will be unseated from the valve seat 125 and fuel injection will occur through the spray holes 126. The unseating of the needle valve 123 lifts the needle valve 123, the piezoelectric needle valve actuator 122 and the spring seat 121 in an upward direction, thereby compressing the spring 120 against the spacer 115. Activation of the piezoelectric needle valve actuator 122 will be described hereinbelow.

Figure 4:
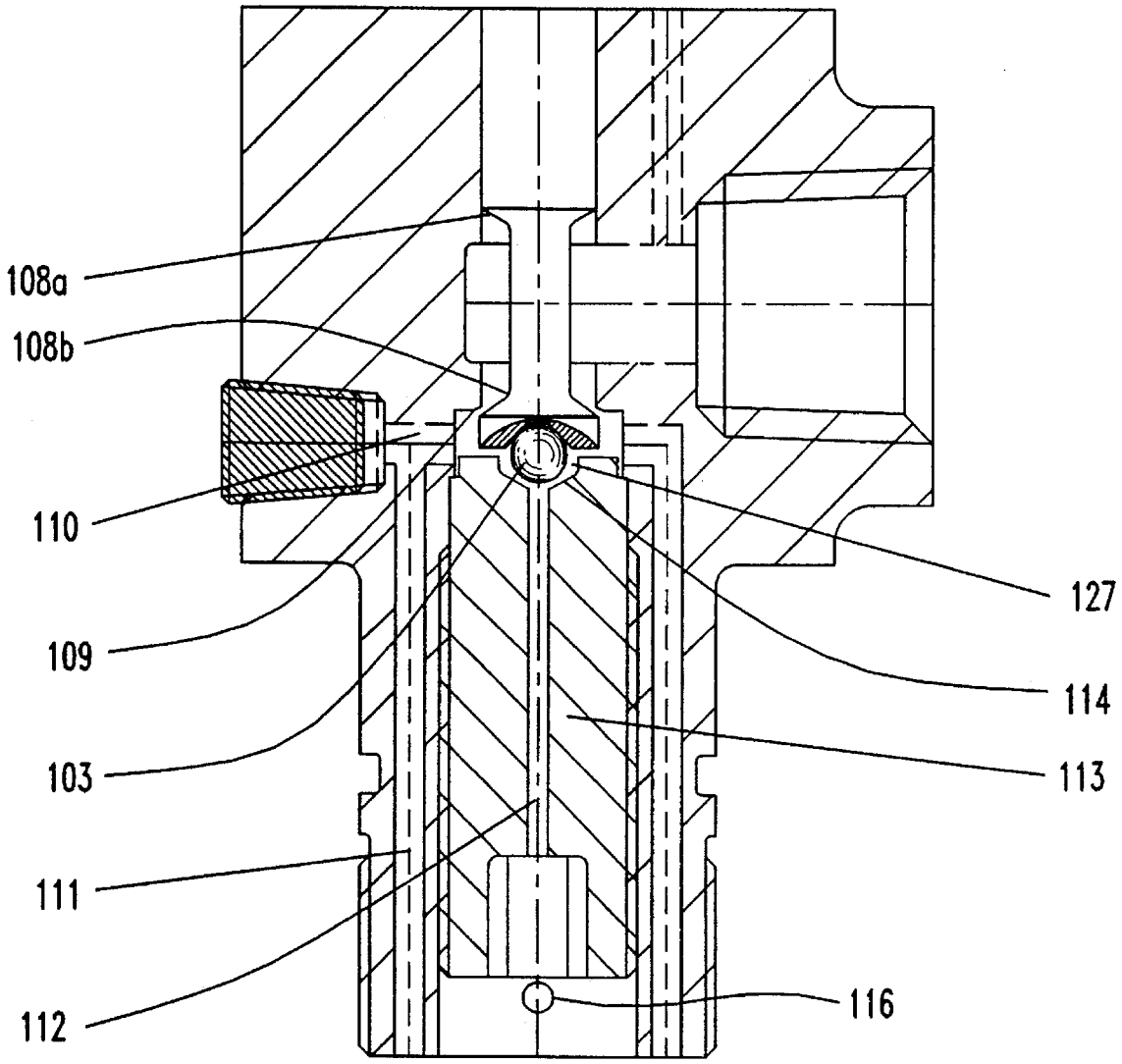

When current is removed from the piezoelectric shuttle valve actuator 101, it returns to its original longitudinal length, pulling the shuttle valve 105 upwards (with the help of the spring 104 acting against the retaining surface 129), thereby seating the shuttle valve 105 against the valve seat 109 once again. The seating of the shuttle valve 105 stops flow of fuel from the equalized pressure chamber 107 to the fuel passage 110/111. As illustrated in FIG. 2, when the shuttle valve 105 is seated, the high pressure fuel is contained within the equalized pressure chamber 107, eliminating the rail "life pressure" from the nozzle area. As a safety feature, if the spring 104 should become broken, and the rail pressure were operative to unseat the shuttle valve 105 from its seat 109, the fuel pressure in the design of the present invention is balanced between the pressure on the shuttle valve 105 and the pressure on the check ball 103, as illustrated in FIG. 4. These balanced pressures keep both the shuttle valve seat 109 and the check ball seat 114 open and recirculating the rail pressure from the equalized pressure chamber 107 to the fuel chamber 127, and back to the engine fuel tank (not shown) through the passages 112, 116, 117 and 128. Furthermore, the lower pressure in the nozzle 124 will not be high enough to compress the spring 120, thus insuring that the needle 123 is fully seated against the valve seat 125.

Figure 5:
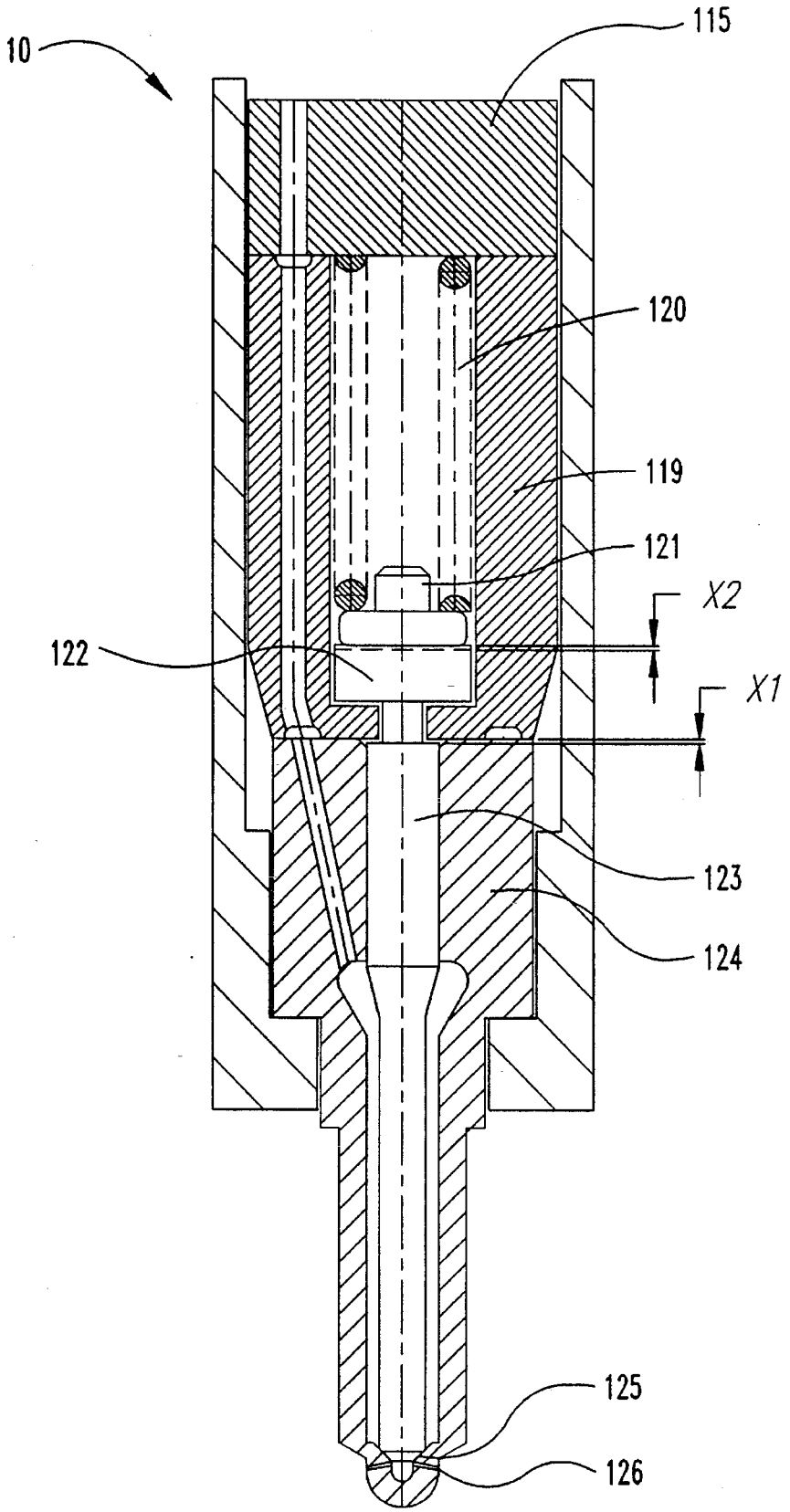
Figure 10:
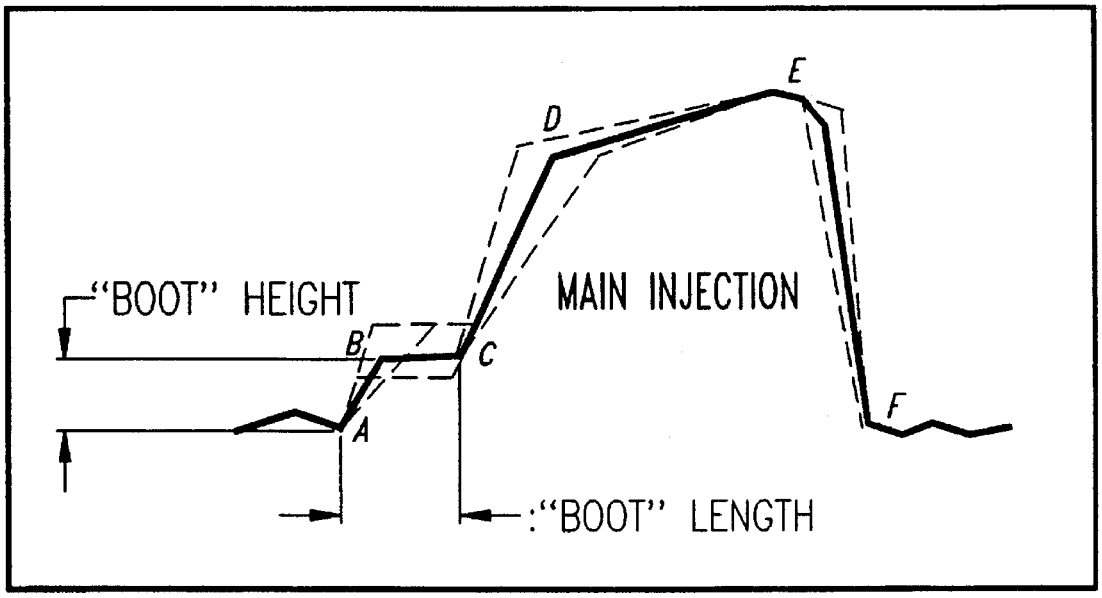
FIG. 10 is a graph of fuel injection pressure vs. time, illustrating a "boot" shaped injection event.

Referring now to FIG. 10, it will be illustrated how the device of the present invention may be used to rate shape the fuel injection curve, allowing the ECM to optimize the shape of the fuel injection event profile depending upon the sensed engine speed. Such rate shaping is accomplished by use of the piezoelectric needle valve actuator 122, which can change its longitudinal dimension depending upon the amount of electric current supplied to it, thereby creating a solid link between the needle valve 123 and the spring seat 121, as shown in FIG. 5. By changing the longitudinal length of the piezoelectric actuator 122, for example by the amount indicated in the dimension X2, for a short time, the spring load on top of the needle 123 may be altered.

With reference once again to FIG. 10, at the beginning of fuel injection (from A to B), with no current applied to the piezoelectric needle valve actuator 122, the needle 123 will be lifted a small amount, thereby allowing a small amount of fuel to be injected into the cylinder. Movement of the injection curve between the point A and B is the start of the injection which is created by applying a current to the piezoelectric shuttle valve actuator 101, thereby starting flow of fuel to the fuel injector nozzle 124. At point B, however, a current is applied to the piezoelectric needle valve actuator 122 which will increase the longitudinal length of the actuator 122 by the dimension indicated by X2 in FIG. 5. Such activation of the piezoelectric needle valve actuator 122 lifts the spring seat 121, compressing the spring 120 and increasing the load applied to the top of the needle 123. This slows down the needle opening which would normally occur, as indicated in FIG. 10 between the points B and C. Eventually, the fuel pressure below the needle 123 will increase to a point which exceeds the load placed on top of the needle 123, thereby lifting the needle 123 further from the valve seat 125, producing maximum lift through the dimension X1 (from C to D in FIG. 10).

From point D to E, the needle 123 will be kept open at the maximum lift X1, and from point E to F (end of injection), the spring 120 will seat the needle 123, creating the so-called "boot" shape injection characteristic illustrated in FIG. 10.

It will be appreciated by those skilled in the art that with use of the injector 10 of the present invention, the current supplied to the piezoelectric needle valve actuator 122 can be changed at any time during the injection event, which will cause variance in the dimensional change X2 experienced by the actuator 122. This variance in the length of the piezoelectric needle valve actuator 122 is operative to change the slope of the injection profile. Therefore, it is possible to alter the shape of the injection profile to certain limits, as illustrated schematically by the dashed lines in FIG. 10. With this ability to change the shape of the injection curve by means of electric signals applied to the fuel injector 10 of the present invention, the engine ECM can be used to alter the shape of the injection curve at any engine speed, producing the best rate shape for improved fuel economy and emissions.

Figure 11:
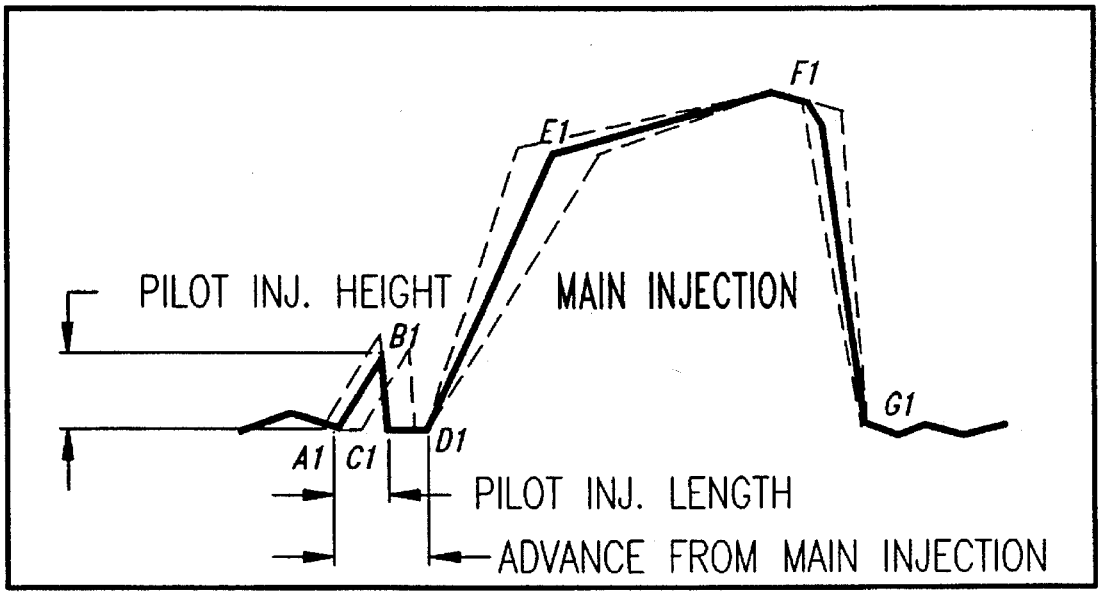
FIG. 11 is a graph of fuel injection pressure vs. time, illustrating a "pilot injection" event.

Referring now to FIG. 11, the piezoelectric needle valve actuator 122 can be energized to increase its length by the dimension X2 before the start of injection (A1). Such preactivation creates a higher load on top of the needle 123. At the point A1, the piezoelectric needle valve actuator 122 is de-energized for a very short time, thereby decreasing the load on top of the needle 123 and making it easier for the pressurized fuel flowing in passage 111 to lift the needle 123 quickly off of the valve seat 125 (from A1 to B1). At point B1, the piezoelectric needle valve actuator 122 is once again energized, increasing the load on top of the needle 123 and seating it back on the seat 125 (from B1 to C1). The needle 123 will remain seated on the valve seat 125 from C1 to D1 until the fuel pressure under the needle 123 increases to a level greater than the load applied to-the top of the needle 123, thereby opening the needle 123 to its maximum lift X1 (from D1 to El).

From E1 to F1, the needle 123 will be kept open by the fuel pressure below it, and at the end of injection (from F1 to G1), the spring 120 will seat the needle 123 because of the pressure drop below the needle 123 (caused by a deactivation of the piezoelectric shuttle valve actuator 101). This pre-injection spike before the main injection creates a so-called "pilot injection" phenomenon which is used for improving engine performance.

As with the injection curve shape of FIG. 10, the parameters utilized to create the injection curve of FIG. 11 may be altered by varying the amount and timing of current applied to the piezoelectric needle valve actuator 122. As indicated schematically by the dashed lines in FIG. 11, the slope of the injection curve, as well as the pilot injection height, pilot injection length and advance from main injection may all be varied by changing the control signals applied from the ECM to the fuel injector 10.

The injection event ends when the piezoelectric shuttle valve actuator 101 is de-energized, regaining its initial length, causing shuttle valve 105 to be seated on its valve seat 109 by spring 104. The decrease in pressure in the nozzle 124 will allow the spring 120 to seat the needle 123 onto the valve seat 125, thereby stopping the injection event.

Figure 6:
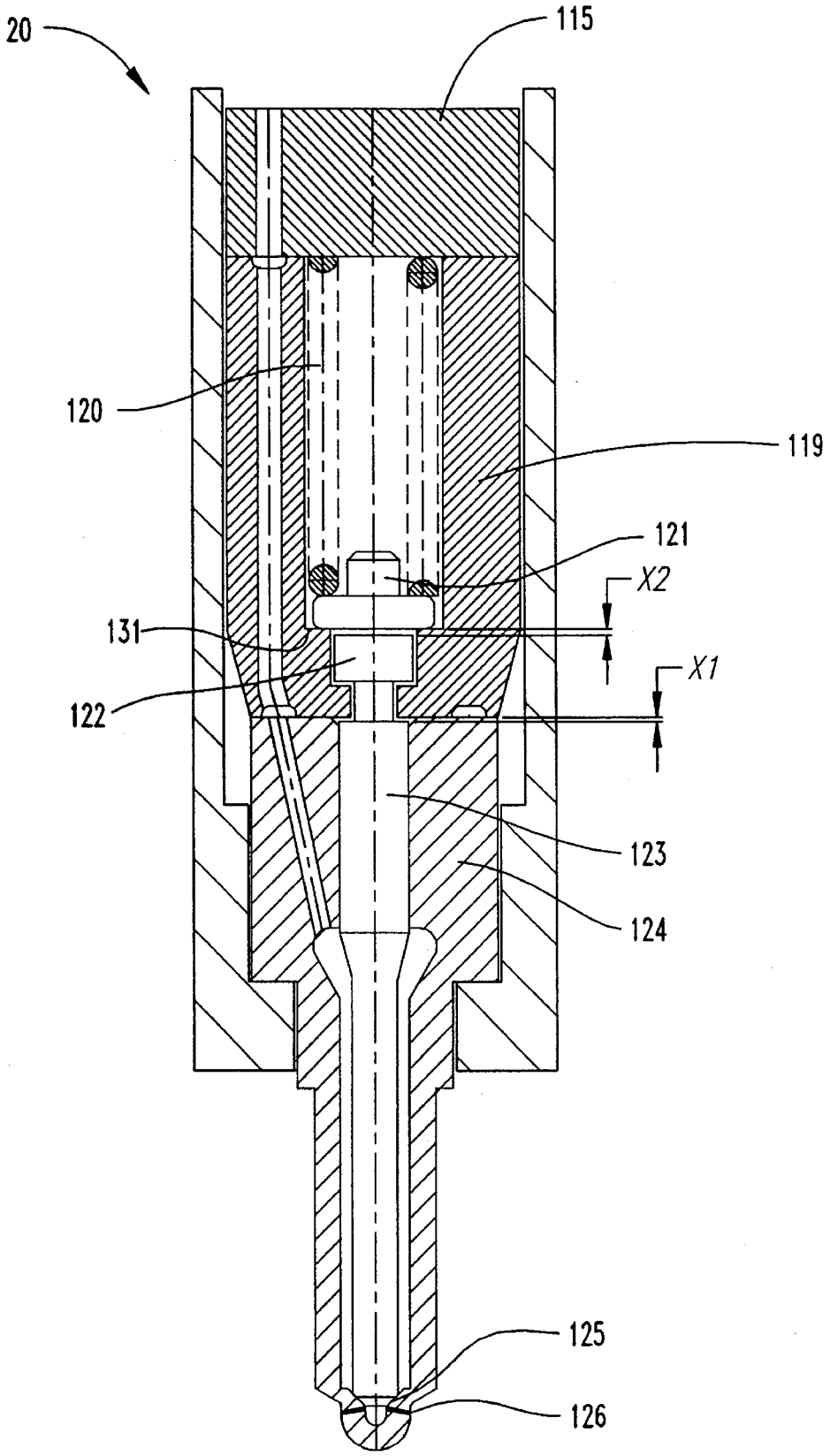
FIG. 6 is a partial cross sectional view of a second embodiment fuel injector of the present invention.

A second embodiment of the present invention is illustrated in FIG. 6. Only a portion of the complete injector is illustrated in FIG. 6 in order to emphasize the differences between the first and second embodiments of the present invention. In the second embodiment injector of FIG. 6, indicated generally at 20, a shoulder 131 is formed within the hollow bore within the spring cage 119. The spring seat 121 is situated above the shoulder 131, while the piezoelectric needle valve actuator 122 is situated below the shoulder 131. When the piezoelectric needle valve actuator 122 is deactivated, there exists a gap between the piezoelectric needle valve actuator 122 and the spring seat 121 having a longitudinal dimension as indicated by X2. The gap X2 is present when the piezoelectric needle valve actuator 122 is not energized or energized with a lower current. The gap can be reduced or eliminated by applying higher current values to the piezoelectric needle valve actuator 122. The presence of the gap X2 relieves for a short period the spring load on the top of needle 123 allowing for an initial quick lift of the needle 123 in response to fuel pressure in the passage 111. No loading force is applied to the top of the needle 123 until the needle 123 and piezoelectric needle valve actuator 122 are moved through the distance X2, bringing them into contact with the spring seat 121. By energizing or de-energizing or changing the current values applied to the piezoelectric needle valve actuator 122, a variety of different rate shapes can be created using the fuel injector 20 of the present invention (including "boot" shapes and "pilot injection").

Figure 7:
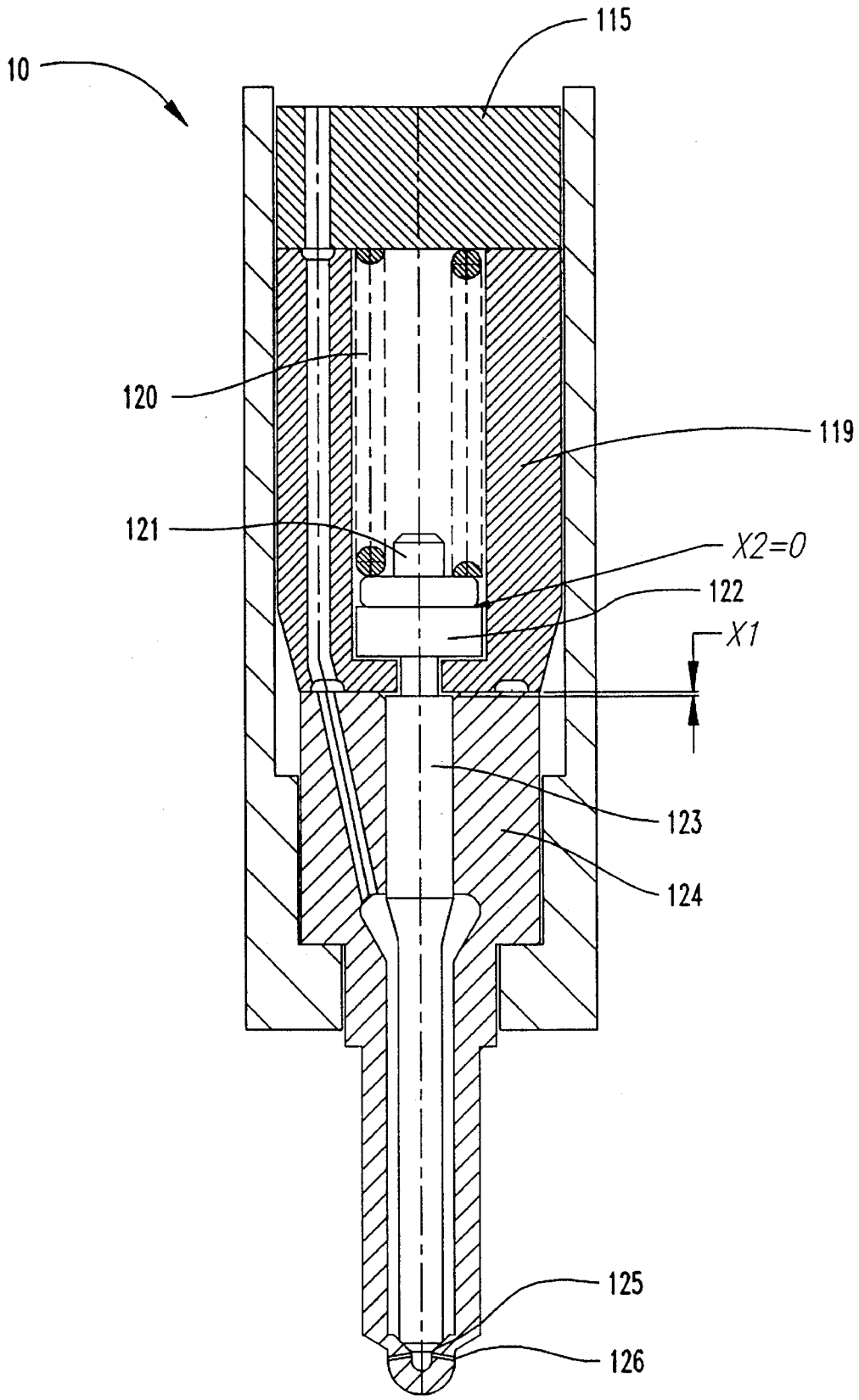
FIG. 7 is a partial cross sectional view of the first embodiment fuel injector of FIG. 1.

Referring now to FIG. 7, there is illustrated a detailed view of the distal end of the first embodiment fuel injector 10 of FIG. 1. In contrast to the fuel injector 20 of the second embodiment of the present invention, it will be appreciated by comparison of FIG. 6 and 7 that the dimension X2 is equal to 0 in the first embodiment fuel injector 10 of FIG. 7.

Figure 8:
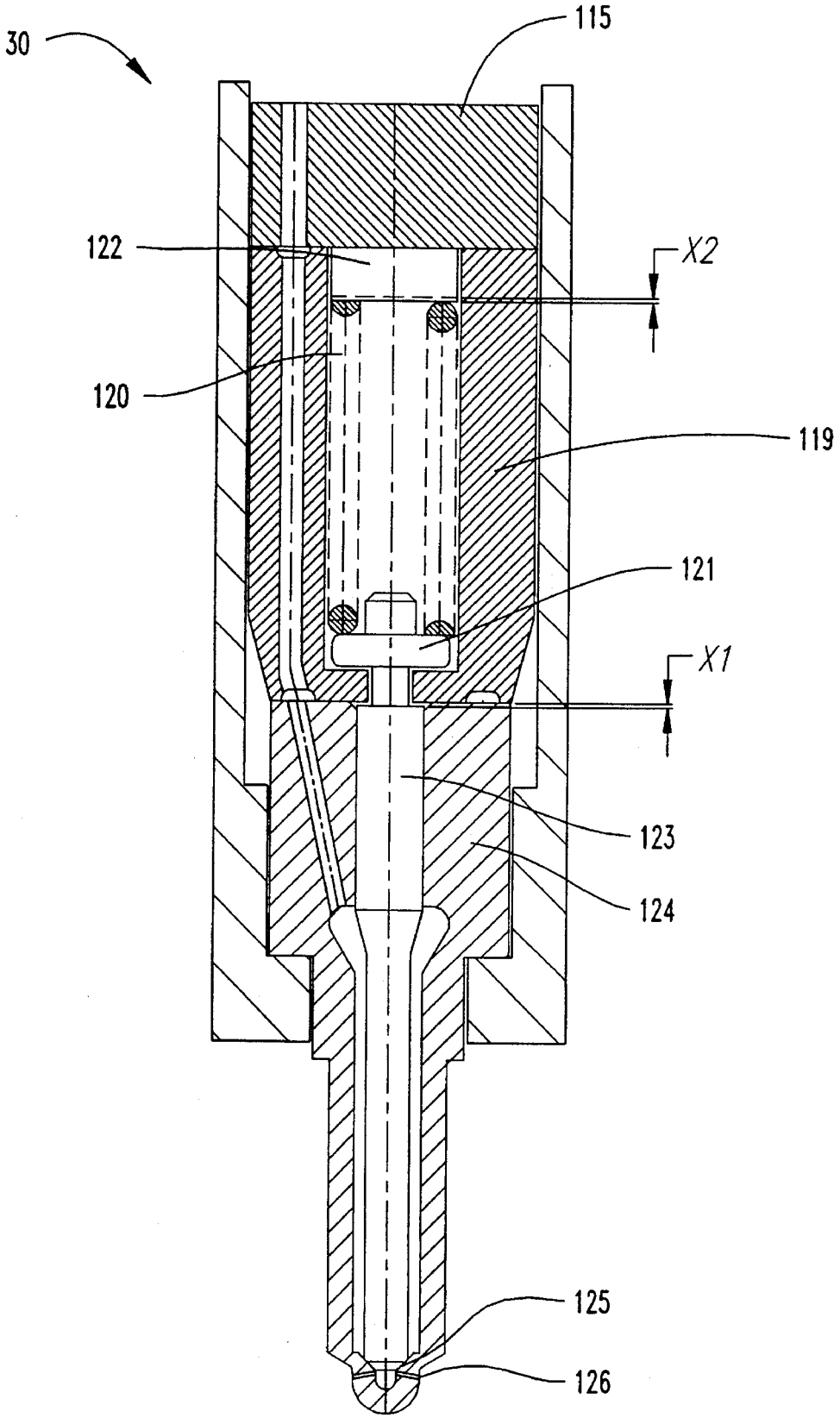
FIG. 8 is a partial cross sectional view of a third embodiment of the present invention.

Referring now to FIG. 8, there is illustrated a third embodiment fuel injector of the present invention, indicated generally at 30. Only the distal end of the injector 30 is illustrated in FIG. 8, the remaining portions of the injector being identical to those of the first embodiment injector 10 of FIG. 1. In the injector 30, the piezoelectric needle valve actuator 122 is placed between the spacer 115 and the top of the spring 120, within the hollow cylindrical bore of the spring cage 119. Changing the longitudinal dimension of the piezoelectric needle valve actuator 122 by applying a current thereto will change the spring load applied to the top of the needle 123. Therefore, by applying different current values to the piezoelectric needle valve actuator 122, different rate shapes may be generated using the fuel injector 30.

Figure 9:
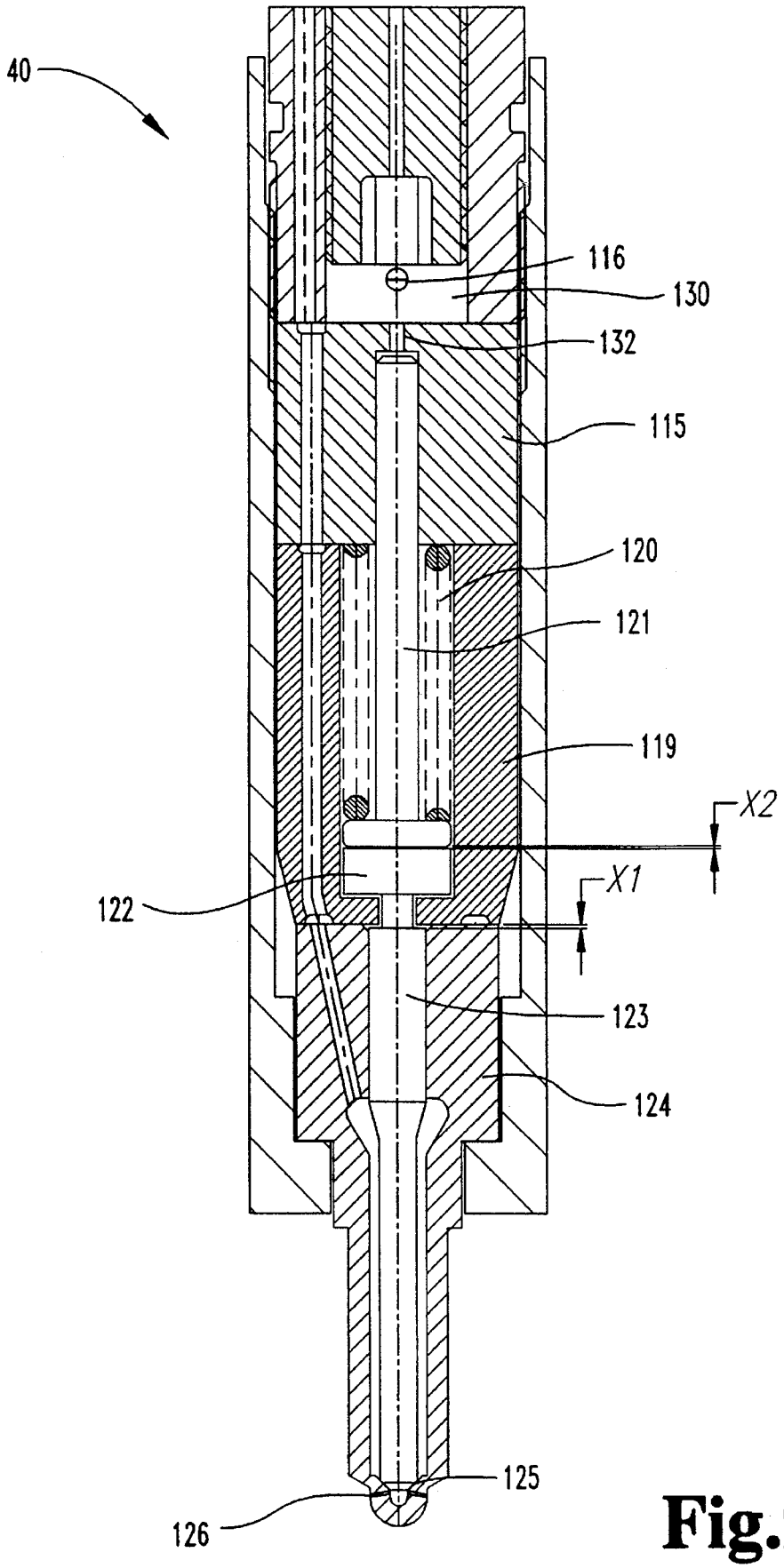
FIG. 9 is a partial cross sectional view of a fourth embodiment of the present invention.

Referring now to FIG. 9, there is illustrated a fourth embodiment fuel injector of the present invention, indicated generally at 40. Only the distal portion of the injector 40 is illustrated in FIG. 9, the remaining portions being identical to the first embodiment injector 10 of FIG. 1. In the injector 40, the spring seat 121 is greatly elongated such that its proximal end is slidingly received with a bore in the spacer 115. A hollow bore 132 through the top of the spacer 115 couples the pressure chamber 130 to the top surface of the spring seat 121. Pressure created by the fuel in the pressure chamber 130 acts on the top surface of the spring seat 121, thereby supplementing the load created by the spring 120, closing the needle 123 more quickly and thereby reducing the amount of unburned fuel to get into the exhaust. This has the effect of reducing engine fuel consumption. In the embodiment of FIG. 9, it is necessary that the passage 116 be sized appropriately in order to maintain the required pressure within the pressure chamber 130 for the pressure assistance. The same remaining pressure in the pressure chamber 130 will be used to slow the lift of the spring seat 121, and hence the life of the needle 123 at the start of the next injection event.

Figure 12A:
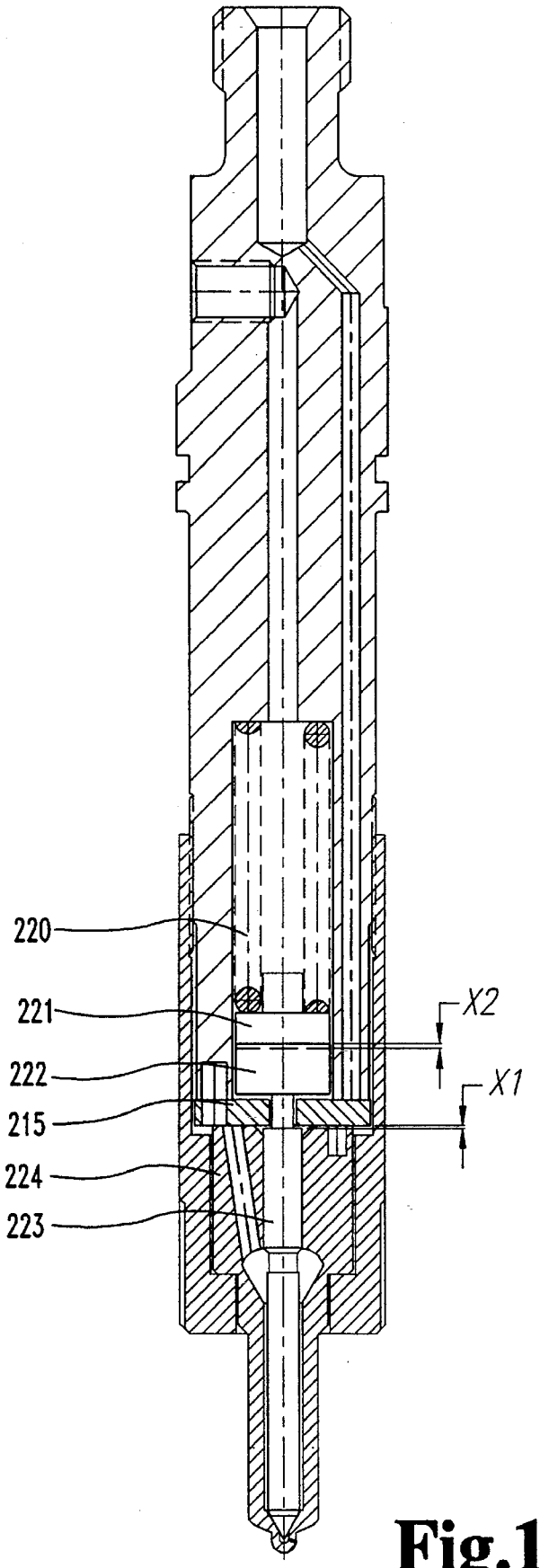
FIGS. 12A–C are cross sectional views of a fifth, sixth and seventh embodiment, respectively, of the present invention.
Figure 12B:
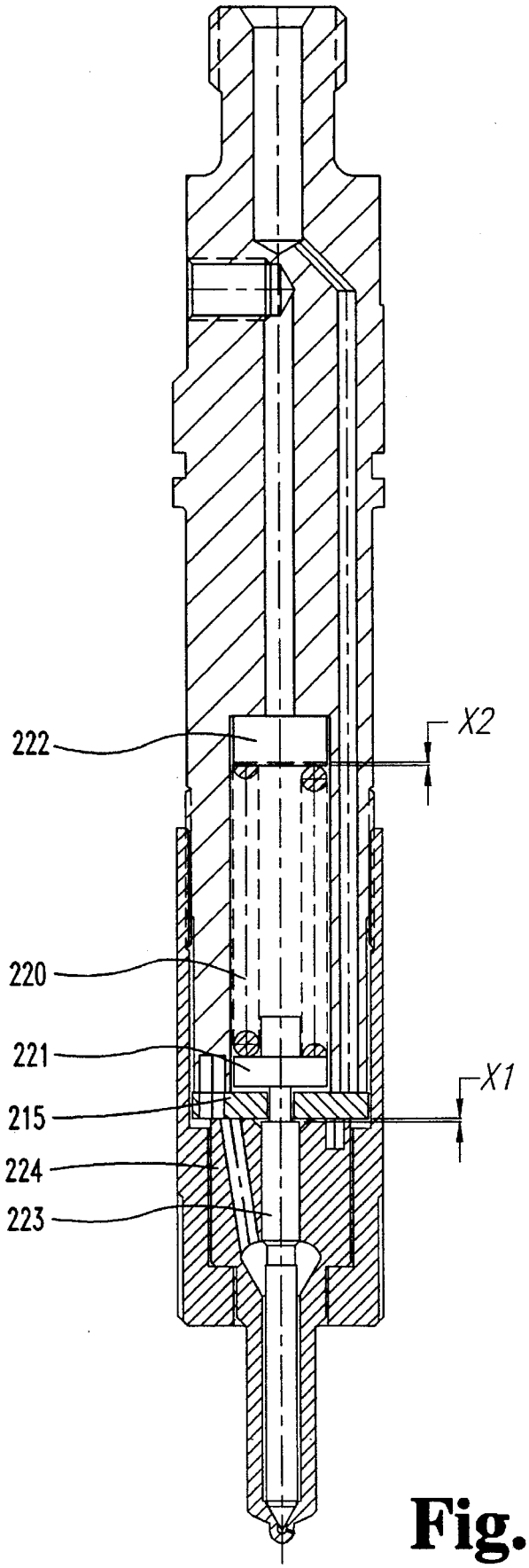
Figure 12C:
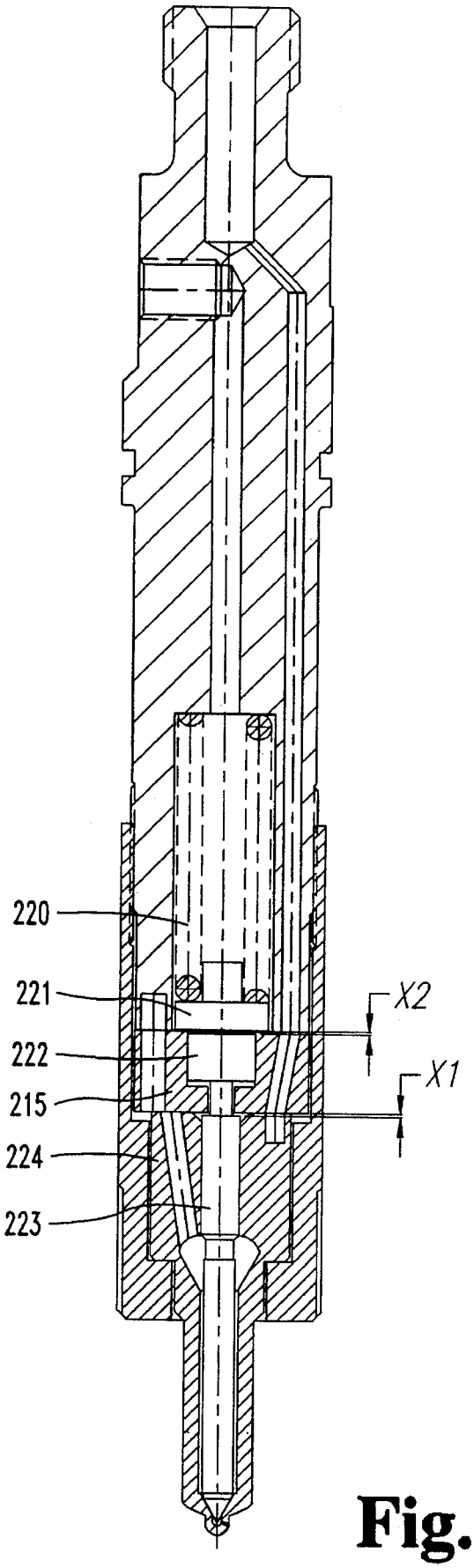

Referring now to FIGS. 12A–C, there are illustrated other embodiments of a standard mechanical injector which incorporates the same rate shaping features as described above for high pressure electronic common rail injectors. The standard mechanical injectors may be designed using a piezoelectric actuator 222 mounted between the needle 223 and spring seat 221 with a gap X2 (FIG. 12C), by forming a solid link between the piezoelectric actuator 222 and spring seat 221 (FIG. 12A), and by locating the piezoelectric actuator 222 on top of the spring 220 (FIG. 12B). In each of the configurations of FIGS. 12A–C, the piezoelectric actuator 222 is used in a similar manner as described above with reference to a high pressure common rail injector.

Figure 13A:
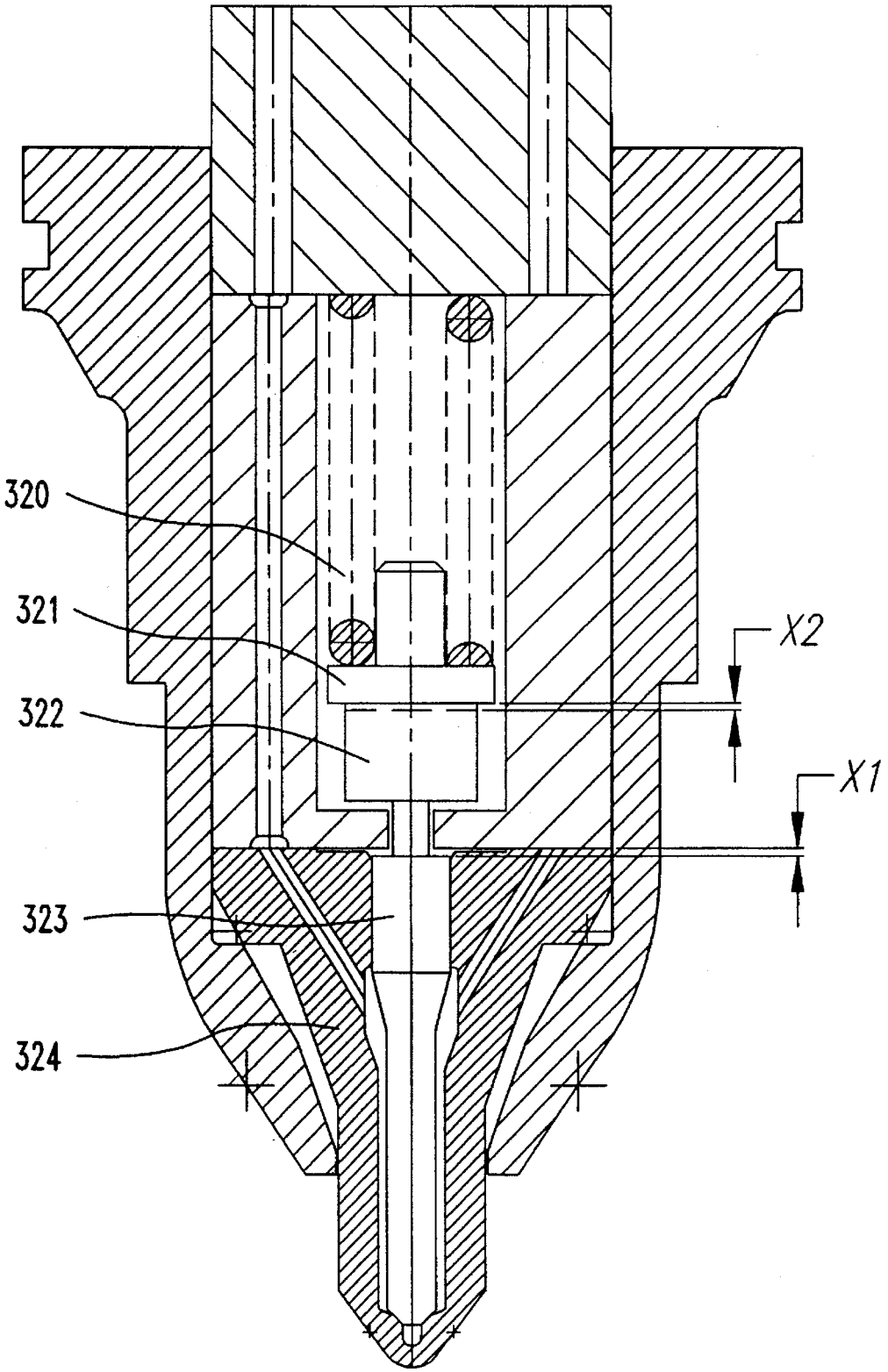
FIGS. 13A–C are cross sectional views of a eighth, ninth, and tenth embodiment, respectively, of the present invention.
Figure 13B:
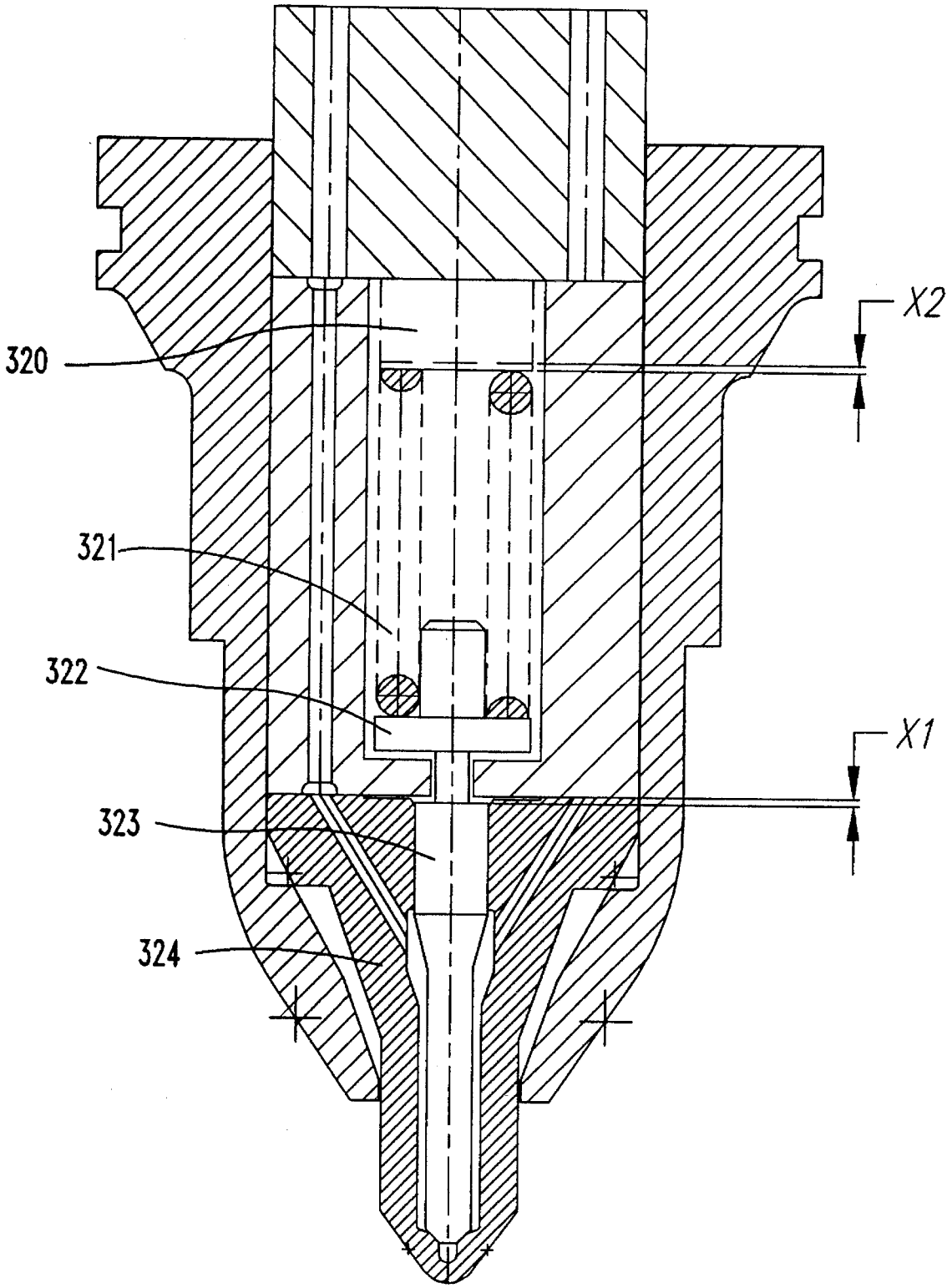
Figure 13C:
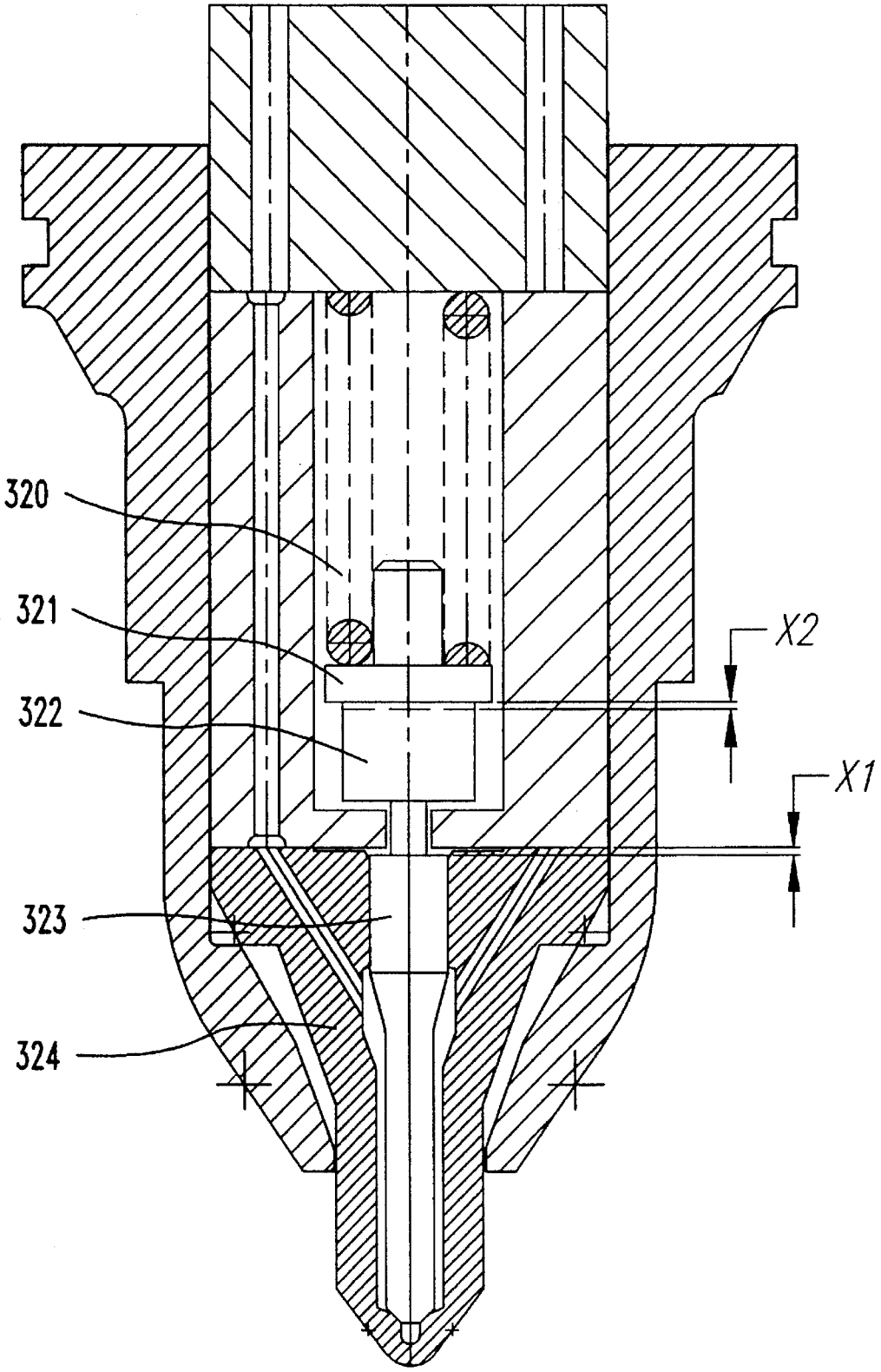

Similarly, FIGS. 13A–C illustrate the use of the variable rate shaping device of the present invention as applied to the electronic or hydraulically controlled unit injectors and amplifier type injectors. For example, a piezoelectric actuator 322 may be located between a needle 323 and a spring seat 321, having a gap X2 (FIG. 13C), by forming a solid link between the piezoelectric actuator 322 and spring seat 321 (FIG. 13A), and by locating the piezoelectric actuator 322 on top of the spring 320 (FIG. 13B). It will be appreciated by those skilled in the art that the operation of each of the injectors illustrated in the FIGS. 13A–C is analogous to the operation as described hereinabove with reference to a high pressure electronic common rail injector.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A high pressure electronic common rail fuel injector, comprising:

an injector body having a fuel inlet therein;

a first fuel chamber formed within the injector body and in fluid communication with the fuel inlet;

a second fuel chamber formed within the injector body;

a nozzle coupled to the injector body;

a first fuel passage fluidy coupling the second fuel chamber to the nozzle;

a shuttle valve seat formed in the injector body between the first and second fuel chambers;

a shuttle valve slidingly disposed within the injector body; and a shuttle valve actuator mechanically linked to the shuttle valve, wherein activation of the shuttle valve actuator operates to unseat the shuttle valve from the shuttle valve seat, thereby allowing fuel flow between the first and second fuel chambers, and deactivation of the shuttle valve actuator operates to seat the shuttle value on the shuttle valve seat, thereby preventing fuel flow between the first and second fuel chambers.

2. A high pressure electronic common rail fuel injector, comprising:

an injector body having a fuel inlet therein;

a first fuel chamber formed within the injector body and in fluid communication with the fuel inlet;

a second fuel chamber formed within the injector body;

a nozzle coupled to ie injector body;

a first fuel passage fluidly coupling the second fuel chamber to the nozzle;

a shuttle valve seat formed in the injector body between the first and second fuel chambers;

a shuttle valve slidingly disposed within the injector body;

a shuttle valve actuator coupled to the shuttle valve, wherein activation of the shuttle valve actuator operates to unseat the shuttle valve from the shuttle valve seat, thereby allowing fuel flow between the first and second fuel chambers, and deactivation of the shuttle valve actuator operates to seat the shuttle valve on the shuttle valve seat, thereby preventing fuel flow between the first and second fuel chambers;

a third fuel chamber;

a second fuel passage fluidly coupling the second fuel chamber to the third fuel chamber;

a check ball seat formed between the second fuel chamber and the second fuel passage; and a check ball loosely contained between a bottom surface of the shuttle valve and the check ball seat;

wherein activation of the shuttle valve actuator operates to seat the check ball on the check ball seat, thereby preventing fuel flow between the second fuel chamber and the second fuel passage, and deactivation of the shuttle valve actuator operates to unseat the check ball from the check ball seat, thereby allowing fuel flow between the second fuel chamber and the second fuel passage.

3. The fuel injector of claim 2, further comprising:

a recess formed in a bottom surface of the shuttle valve, wherein the recess is substantially filled by an upper portion of the check ball.

4. The fuel injector of claim 2, further comprising:

a fuel drain formed in the injector body and operative to drain fuel from the fuel injector; and a drain hole coupling the third fuel chamber to the fuel drain for fluid communication.

5. The fuel injector of claim 1, further comprising:

a biasing member coupled to the shuttle valve and operative to apply a biasing force to the shuttle valve in a direction tending to seat the shuttle valve against the shuttle valve seat.

6. The fuel injector of claim 1, further comprising:

a needle valve seat formed in a distal end of the nozzle;

a needle valve slidingly disposed within the nozzle; and a controllable biasing member coupled to the needle valve and operative to apply a variable biasing force to the needle valve in a direction tending to seat the needle valve against the needle valve seat;

wherein the variable biasing force is varied by varying an amount of current applied to the controllable biasing member.

7. A high pressure electronic common rail fuel injector, comprising:

an injector body having a fuel inlet therein;

a first fuel chamber formed within the injector body and in fluid communication with the fuel inlet;

a second fuel chamber formed within the injector body;

a nozzle coupled to the injector body;

a first fuel passage fluidly coupling the second fuel chamber to the nozzle;

a shuttle valve seat formed in the injector body between the first and second fuel chambers;

a shuttle valve slidingly disposed within the injector body;

a shuttle valve actuator coupled to the shuttle valve, wherein activation of the shuttle valve actuator operates to unseat the shuttle valve from the shuttle valve seat thereby allowing fuel flow between the first and second fuel chambers, and deactivation of the shuttle valve actuator operates to seat the shuttle valve on the shuttle valve seat thereby preventing fuel flow between the first and second fuel chambers;

a needle valve seat formed in a distal end of the nozzle;

a needle valve slidingly disposed within the nozzle;

a controllable biasing member coupled to the needle valve and operative to apply a variable biasing force to the needle valve in a direction tending to seat the needle valve against the needle valve seat, the controllable biasing member comprising:

a spring disposed within a first bore in the nozzle;

a spring seat disposed within the first bore and coupled to one end of the spring;

a needle valve actuator coupled between the needle valve and the spring seat, wherein activation of the needle valve actuator operates to increase the variable biasing force; and wherein the variable biasing force is varied by varying an amount of current applied to the controllable biasing member.

8. The fuel injector of claim 7, further comprising:

a second bore in the nozzle, the second bore coupling the third fuel chamber and the first bore;

wherein the spring seat includes an extension slidingly received within the second bore, such that fluid pressure within the third fuel chamber is applied to the spring seat, thereby increasing the variable biasing force.

9. The fuel injector of claim 6, wherein the controllable biasing member comprises:

a spring disposed within a bore in the nozzle;

a spring seat disposed within the bore and coupled to one end of the spring, wherein expansion of the spring is limited by an annular shoulder within the bore which is distal of the spring seat and engages the spring seat; and a piezoelectric needle valve actuator disposed within the bore distal of the annular shoulder and coupled to the needle valve, wherein there is a gap between the piezoelectric needle valve actuator and the spring seat when the piezoelectric needle valve acutator is deactivated, and activation of the piezoelectric needle valve actuator decreases the gap.

10. The fuel injector of claim 6, wherein the controllable biasing member comprises:

a piezoelectric needle valve actuator;

a spring seat coupled to the needle valve; and a spring coupled between the piezoelectric needle valve actuator and the spring seat;

wherein activation of the piezoelectric needle valve actuator operates to increase the variable biasing force.

11. The fuel injector of claim 1, further including an annular recess formed in the shuttle valve in an area where the shuttle valve traverses the first fuel chamber, wherein a first axial force generated by fuel pressure acting on a first shoulder of the annular recess is balanced by a second axial force generated by fuel pressure acting on a second shoulder of the annular recess.

12. A fuel injector, comprising:

an injector body having a fuel inlet therein;

a nozzle coupled to the injector body;

a first fuel passage fluidly coupling the fuel inlet and the nozzle;

a needle valve seat formed in a distal end of the nozzle;

a needle valve slidingly disposed within the nozzle; and a controllable biasing member mechanically linked to the needle valve and operative to apply a variable biasing force to the needle valve in a direction tending to seat the needle valve against the needle valve seat;

wherein the variable biasing force is varied by varying an amount of current applied to the controllable biasing member.

13. A fuel injector, comprising:

an injector body having a fuel inlet therein;

a nozzle coupled to the injector body;

a first fuel passage fluidly coupling the fuel inlet and the nozzle;

a needle valve seat formed in a distal end of the nozzle;

a needle valve slidingly disposed within the nozzle;

a controllable biasing member coupled to the needle valve and operative to apply a variable biasing force to the needle valve in a direction tending to seat the needle valve against the needle valve seat, the controllable biasing member comprising:

a spring disposed within a first bore in the nozzle;

a spring seat disposed within the first bore and coupled to one end of the spring;

a needle valve actuator coupled between the needle valve and the spring seat, wherein activation of the needle valve actuator operates to increase the variable biasing force; and wherein the variable biasing force is varied by varying an amount of current applied to the controllable biasing member.

14. The fuel injector of claim 13, further comprising:

a pressure chamber;

a second bore in the nozzle, the second bore coupling the pressure chamber and the first bore;

wherein the spring seat includes an extension slidingly received within the second bore, such that pressure within the pressure chamber is applied to the spring seat, thereby increasing the variable biasing force.

15. The fuel injector of claim 12, wherein the controllable biasing member comprises:

a spring disposed within a bore in the nozzle;

a spring seat disposed within the bore and coupled to one end of the spring, wherein expansion of the spring is limited by an annular shoulder within the bore which is distal of the spring seat and engages the spring seat; and a piezoelectric needle valve actuator disposed within the bore distal of the annular shoulder and coupled to the needle valve, wherein there is a gap between the piezoelectric needle valve actuator and the spring seat when the piezoelectric needle valve actuator is deactivated, and activation of the piezoelectric needle valve actuator decreases the gap.

16. The fuel injector of claim 12, wherein the controllable biasing member comprises:

a piezoelectric needle valve actuator;

a spring seat coupled to the needle valve; and a spring coupled between the piezoelectric needle valve actuator and the spring seat;

wherein activation of the piezoelectric needle valve actuator operates to increase the variable biasing force.

17. The fuel injector of claim 12, further comprising:

a first fuel chamber formed within the injector body and in fluid communication with the fuel inlet;

a second fuel chamber formed within the injector body and in fluid communication with the fuel inlet;

a first fuel passage fluidly coupling the second fuel chamber to the nozzle;

a shuttle valve seat formed in the injector body between the first and second fuel chambers;

a shuttle valve slidingly disposed within the injector body; and a piezoelectric shuttle valve actuator coupled to the shuttle valve, wherein activation of the piezoelectric shuttle valve actuator operates to unseat the shuttle valve from the shuttle valve seat, thereby allowing fuel flow between the first and second fuel chambers, and deactivation of the piezoelectric shuttle valve actuator operates to seat the shuttle valve on the shuttle valve seat, thereby preventing fuel flow between the first and second fuel chambers.

18. The fuel injector of claim 17, further comprising:

a second fuel passage fluidly coupling the second fuel chamber to the pressure chamber;

a check ball seat formed between the second fuel chamber and the second fuel passage; and a check ball loosely contained between a bottom surface of the shuttle valve and the check ball seat;

wherein activation of the piezoelectric shuttle valve actuator operates to seat the check ball on the check ball seat, thereby preventing fuel flow between the second fuel chamber and the second fuel passage, and deactivation of the piezoelectric shuttle valve actuator operates to unseat the check ball from the check ball seat, thereby allowing fuel flow between the second fuel chamber and the second fuel passage.

19. The fuel injector of claim 18, further comprising:

a recess formed in a bottom surface of the shuttle valve, wherein the recess is substantially filled by an upper portion of the check ball.

20. The fuel injector of claim 18, further comprising:

a fuel drain formed in the injector body and operative to drain fuel from the fuel injector; and a drain hole coupling the third fuel chamber to the fuel drain for fluid communication.

21. The fuel injector of claim 17, further comprising:

a biasing member coupled to the shuttle valve and operative to apply a biasing force to the shuttle valve in a direction tending to seat the shuttle valve against the shuttle valve seat.

22. The fuel injector of claim 17, further including an annular recess formed in the shuttle valve in an area where the shuttle valve traverses the first fuel chamber, wherein a first axial force generated by fuel pressure acting on a first shoulder of the annular recess is balanced by a second axial force generated by fuel pressure acting on a second shoulder of the annular recess.

23. A method of controlling a fuel injection event in an engine, comprising the steps of:

(a) supplying pressurized fuel to a fuel injector, the fuel injector comprising:

an injector body having a fuel inlet therein;

a nozzle coupled to the injector body;

a first fuel passage fluidly coupling the fuel inlet and the nozzle;

a needle valve seat formed in a distal end of the nozzle;

a needle valve slidingly disposed within the nozzle; and a controllable biasing member mechanically linked to the needle valve and operative to apply a variable biasing force to the needle valve in a direction tending to seat the needle valve against the needle valve seat;

wherein the variable biasing force is varied by varying an amount of current applied to the controllable biasing member;

(b) sensing an engine speed of the engine;

(c) determining an optimum profile of the fuel injection event based upon the engine speed; and (d) varying the amount of current applied to the controllable biasing member during the fuel injection event in order to produce the optimum profile.

24. A method of controlling a fuel injection event in an engine, comprising the steps of:

(a) supplying pressurized fuel to a fuel injector, the fuel injector comprising:

an injector body having a fuel inlet therein;

a nozzle coupled to the injector body;

a first fuel passage fluidly coupling the fuel inlet and the nozzle;

a needle valve seat formed in a distal end of the nozzle;

a needle valve slidingly disposed within the nozzle; and a controllable biasing member mechanically linked to the needle valve and operative to apply a variable biasing force to the needle valve in a direction tending to seat the needle valve against the needle valve seat;

wherein the variable biasing force is varied by varying an amount of current applied to the controllable biasing member;

(b) determining an optimum profile of the fuel injection event; and (d) varying the amount of current applied to the controllable biasing member during the fuel injection event in order to produce the optimum profile.

* * * * *